US010522928B1

(12) United States Patent
Tang et al.

(10) Patent No.: US 10,522,928 B1
(45) Date of Patent: Dec. 31, 2019

(54) ELECTRIC CONNECTOR PLUG, ELECTRIC CONNECTOR SOCKET, AND ELECTRIC CONNECTOR ASSEMBLY

(71) Applicant: Suzhou e-Conn Technology Co., Ltd., Suzhou, Jiang Su Province (CN)

(72) Inventors: Ling-Ming Tang, Suzhou (CN); Qi-Shun Feng, Suzhou (CN); Liang Xiao, Suzhou (CN)

(73) Assignee: SUZHOU E-CONN TECHNOLOGY CO., LTD., Suzhou, Jiang Su Province (CN)

( * ) Notice: Subject to any disclaimer, the term of this patent is extended or adjusted under 35 U.S.C. 154(b) by 0 days.

(21) Appl. No.: 16/248,205

(22) Filed: Jan. 15, 2019

(51) Int. Cl.

| | |
|---|---|
| ***H01R 29/00*** | (2006.01) |
| ***H01R 13/04*** | (2006.01) |
| ***H01R 13/11*** | (2006.01) |
| *H01R 12/55* | (2011.01) |

(52) U.S. Cl.
CPC ..... *H01R 13/04* (2013.01); *H01R 13/11* (2013.01); *H01R 12/55* (2013.01)

(58) Field of Classification Search
CPC ..... H01R 103/00; H01R 13/941; H01R 23/6873; H01R 13/2442
USPC ..... 439/188, 489, 607.4, 626
See application file for complete search history.

(56) References Cited

U.S. PATENT DOCUMENTS

| | | | | |
|---|---|---|---|---|
| 5,944,546 | A * | 8/1999 | Miyake | H01R 24/46 439/188 |
| 7,247,046 | B1 * | 7/2007 | Wu | H01R 13/6691 439/490 |
| 9,065,219 | B2 * | 6/2015 | Naito | H01R 13/7033 |

* cited by examiner

*Primary Examiner* — Phuong Chi Thi Nguyen
(74) *Attorney, Agent, or Firm* — Muncy, Geissler, Olds & Lowe, P.C.

(57) ABSTRACT

The present invention discloses an electric connector plug, an electric connector socket and an electric connector assembly, which are applied to the butting of connector for a power supply, and capable of avoiding the generation of spark in butting and reducing supply temperature in butting. The electric connector plug, electric connector socket, and electric connector assembly are functional in non-directional butting and can supply large current to electronic apparatuses.

5 Claims, 8 Drawing Sheets

ELECTRIC CONNECTOR PLUG, ELECTRIC CONNECTOR SOCKET, AND ELECTRIC CONNECTOR ASSEMBLY

BACKGROUND OF THE INVENTION a) Field of the Invention

The present invention relates to an electric connector, and more particularly, to an electric connector plug, an electric connector socket, and an electric connector assembly, which are able to prevent from generating spark in butting and to reduce temperature in butting.

b) Description of the Prior Art

Along with the development of technology, the working efficiency of electronic equipment has been increasing gradually. Correspondingly, in order to satisfy the working efficiency of electronic equipment, more powerful power sources are required.

However, as the power sources are getting stronger, the electric current is relatively larger when the conducting terminal of a plug forms point contact with the conducting terminal of a socket, upon inserting in or pulling out a power plug. Therefore, it is easy to result in spark, which may affect the service life of the power plug and the power socket, or even cause threat to the safety of people.

In addition, as the power sources are getting stronger, it is easy to result in high temperature while butting the power plug with the power socket. If the high temperature keeps going, it may damage the electronic equipment or even reduce the service life of battery in the electronic equipment.

Accordingly, the abovementioned conventional power plug and power socket still exist with many shortcomings, and thus need to be improved as they are indeed not a good design.

SUMMARY OF THE INVENTION

Accordingly, the primary object of the present invention is to provide an electric connector plug, including a plug body, plural conducting terminals, plural conducting rings, and a plug housing.

The plug body is provided with a base and a body part which is extended from the base, and the plug body is also provided with a conducting terminal holding chamber which penetrates the base and the body part.

Each conducting terminal is provided with a root as well as a contact part and a welding part which are extended respectively from an end of the root. The conducting terminal is inserted on the base of the plug body via the root, the contact part is accommodated in the conducting terminal holding chamber, the welding part is exposed out of the base of the plug body, and an interior at the front end of the contact part of the conducting terminal is formed with a butting slot.

Each conducting ring is disposed in the butting slot of the contact part of the conducting terminal and is formed with at least a separation slot.

The plug housing encloses the body part of the plug body.

The present invention also provides an electric connector socket, including a socket body, plural splices and a detecting terminal.

The socket body is provided with an electric butting slot, and a rear end of the electric butting slot is provided with plural splice through-holes and a detecting terminal holding chamber.

Each splice is inserted on the splice through-hole of the socket body, and there are three splices, configured in negative pole, positive pole and negative pole. In addition, the negative splice is longer than the positive splice.

The detecting terminal is disposed in the detecting terminal holding chamber of the socket body, and an elastic contact part at the front end of the detecting terminal is disposed at a side of the electric butting slot of the socket body to extend into the electric butting slot.

The present invention also discloses an electric connector assembly, including the abovementioned electric connector plug and electric connector socket. The plug and the socket conduct with each other electrically after butting together, and the assembly is able to prevent from generating spark in butting and to reduce temperature in butting.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
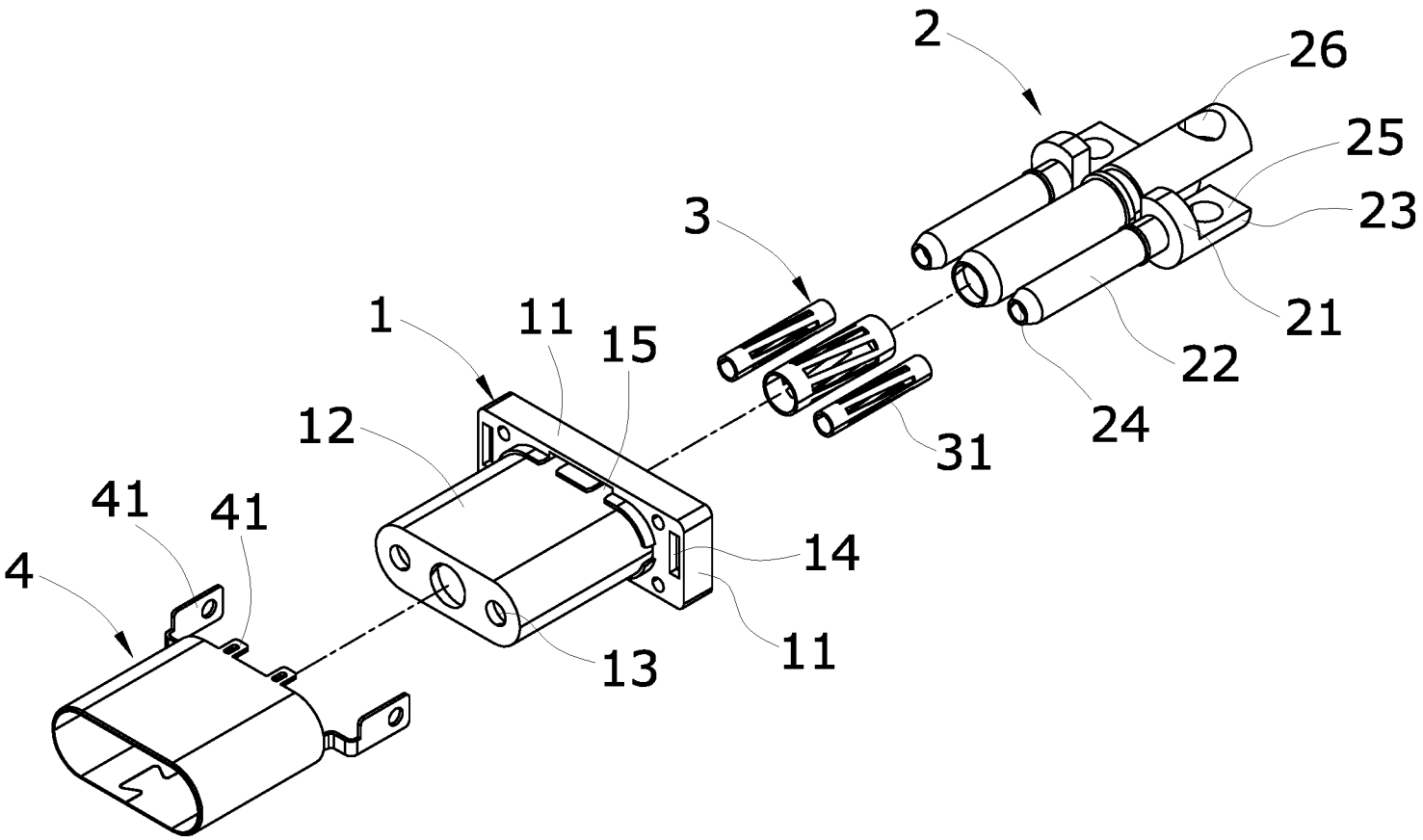
FIG. 1 shows a three-dimensional exploded view of a charging button plug, according to the present invention.
Figure 2:
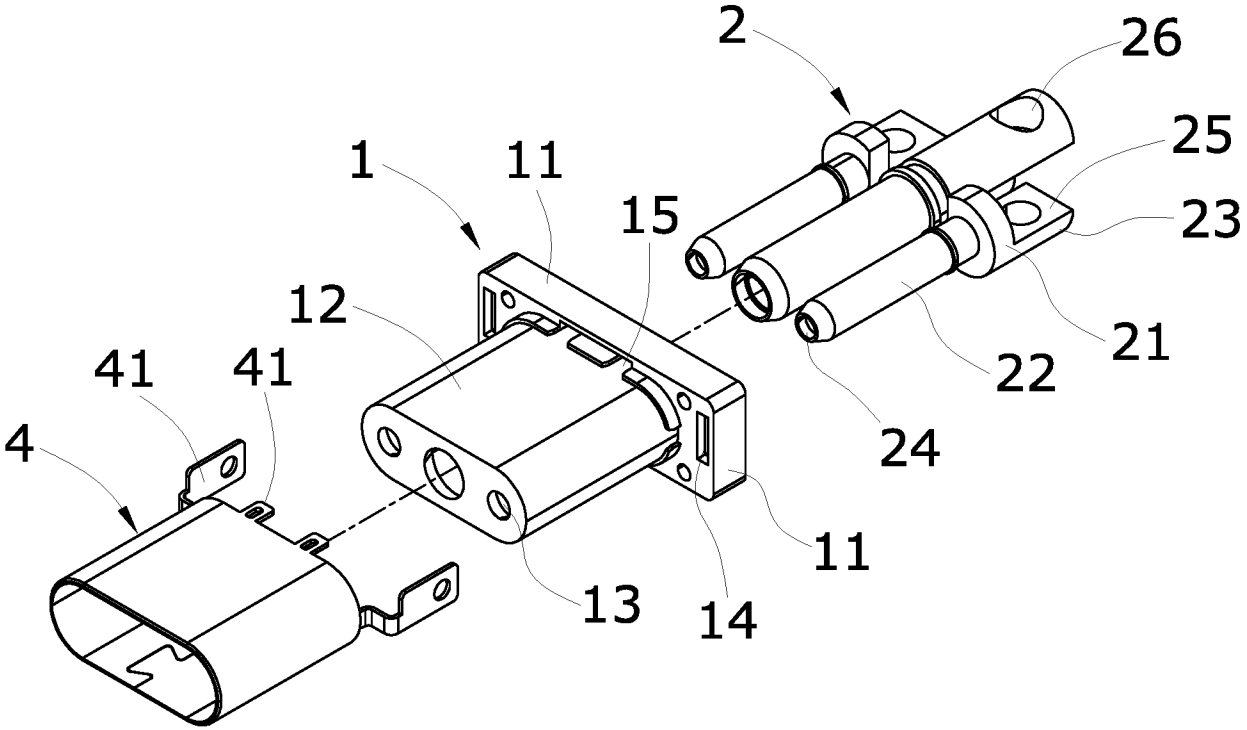
FIG. 2 shows a three-dimensional exploded view of a local assembly of the charging button plug, according to the present invention.
Figure 3:
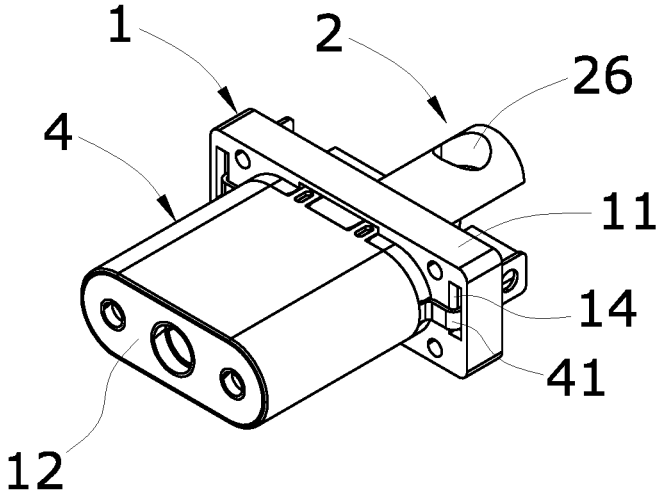
FIG. 3 shows a three-dimensional view of assembly of the charging button plug, according to the present invention.
Figure 4:
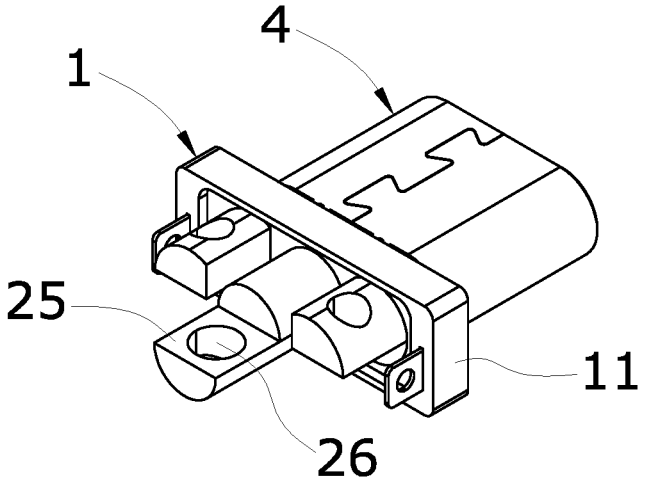
FIG. 4 shows a three-dimensional view of assembly of the charging button plug at another angle, according to the present invention.
Figure 5:
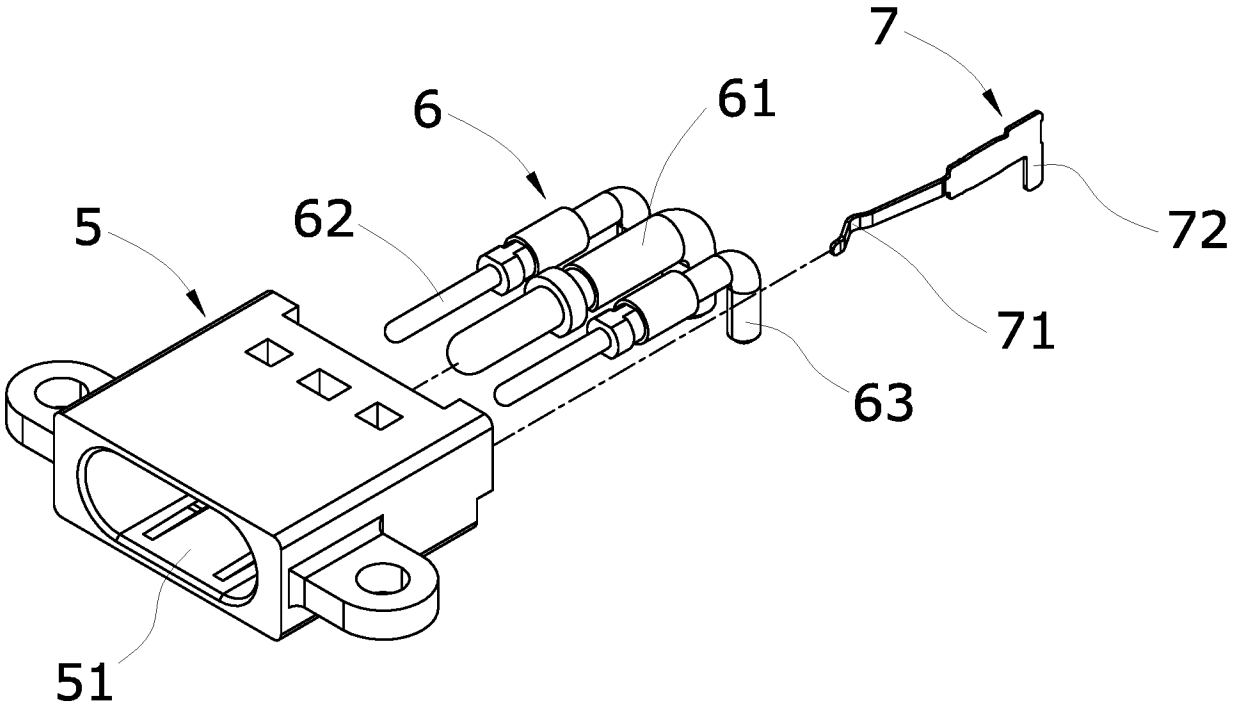
FIG. 5 shows a three-dimensional exploded view of a charging button socket, according to the present invention.
Figure 6:
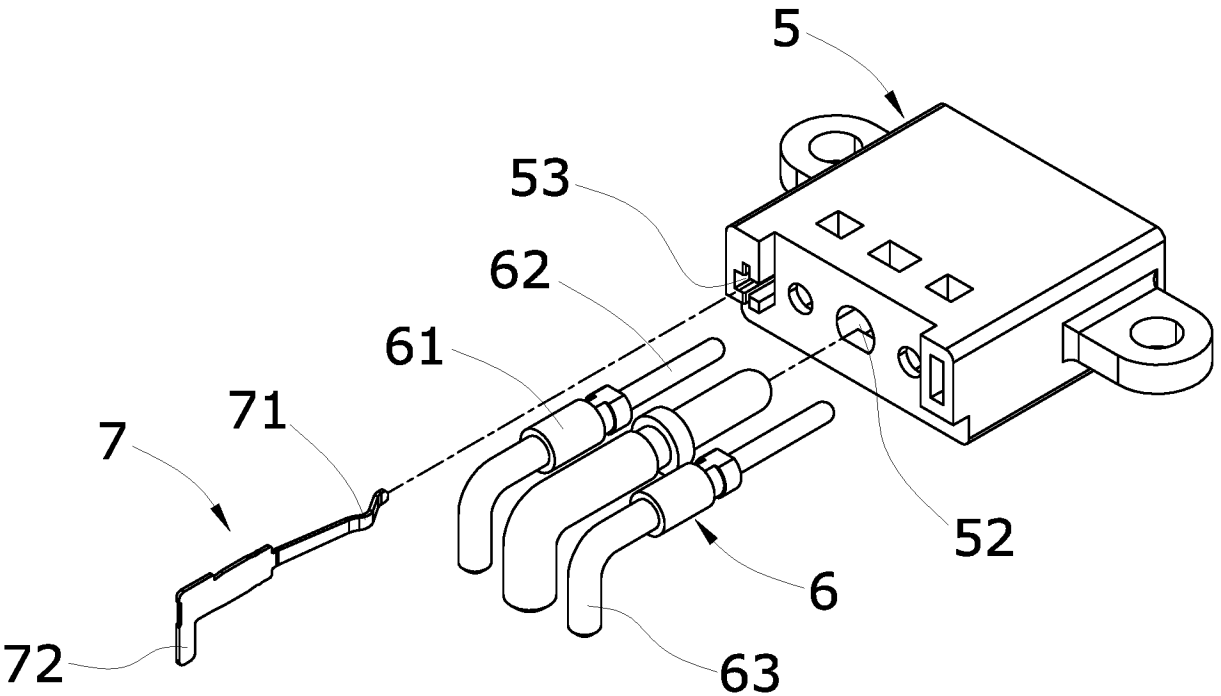
FIG. 6 shows a three-dimensional exploded view of the charging button socket at another angle, according to the present invention.
Figure 7:
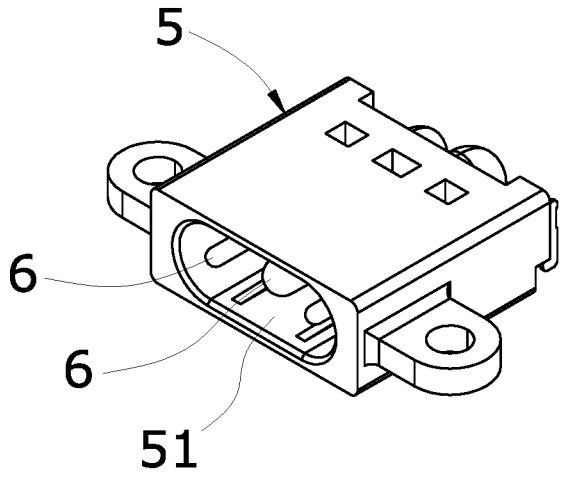
FIG. 7 shows a three-dimensional view of assembly of the charging button socket, according to the present invention.
Figure 8:
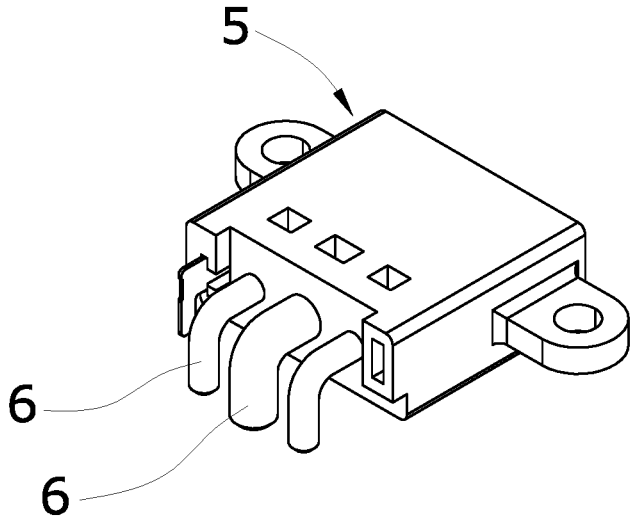
FIG. 8 shows a three-dimensional view of assembly of the charging button socket at another angle, according to the present invention.

Referring to FIGS. 1 to 4, the present invention discloses an electric connector plug, including a plug body 1, plural conducting terminals 2, plural conducting rings 3, and a plug housing 4.

The plug body 1 is provided with a base 11 and a body part 12 which is extended from the base 11. The plug body 1 is also provided with a conducting terminal holding chamber 13 which penetrates the base 11 and the body part 12, each side of the base 11 is provided respectively with a through-hole 14, and an interface between the body part 12 and the base 11 is provided with plural slots 15.

Each conducting terminal 2 includes a root 21 as well as a contact part 22 and a welding part 23 which are extended respectively from an end of the root 21. The conducting terminal 2 is inserted on the base 11 of the plug body 1 via the root 21, the contact part 22 is accommodated in the conducting terminal holding chamber 13, and the welding part 23 is exposed out of the base 11 of the plug body 1. An interior at the front end of the contact part 22 of the conducting terminal 2 is formed with a butting slot 24, the welding part 23 is formed with a vertical plane 25, and the vertical plane 25 is further provided with a through-hole 26 for connecting electrically with other electronic element.

The conducting rings 3 are a metallic annular structure, and each conducting ring 3 is accommodated in the butting slot 24 of the contact part 22 of the conducting terminal 2 to contact with the conducting terminal 2. More specifically, the conducting ring 3 is formed with plural separation slots 31 which are disposed obliquely and annularly relative to the conducting ring 3.

The plug housing 4 is made of metal and encloses the body part 12 of the plug body 1. An insertion part 41 is extended from a tail end of the plug housing 4, and is inserted into the through-hole 14 and the slot 15 on the plug body 1, enabling the plug housing 4 to be stably located on the plug body 1.

Referring to FIGS. 5 to 10, the present invention discloses an electric connector socket, including a socket body 5, plural splices 6, and a detecting terminal 7.

The socket body 5 is made of an insulative material, and a front end thereof is formed with an electric butting slot 51. A rear end of the electric butting slot 51 is provided with plural splice through-holes 52 which penetrate the electric butting slot 51 and a detecting terminal holding chamber 53.

Each splice 6 includes a root 61 as well as a contact part 62 and a welding part 63 which are extended respectively from an end of the root 61. The splices 6 are disposed at a rear end of the electric butting slot 51 of the socket body 5 via the roots 61. The contact part 62 is accommodated in the electric butting slot 51, and the welding part 63 is exposed out of the rear end of the socket body 5 to be welded on a circuit board.

Figure 9:
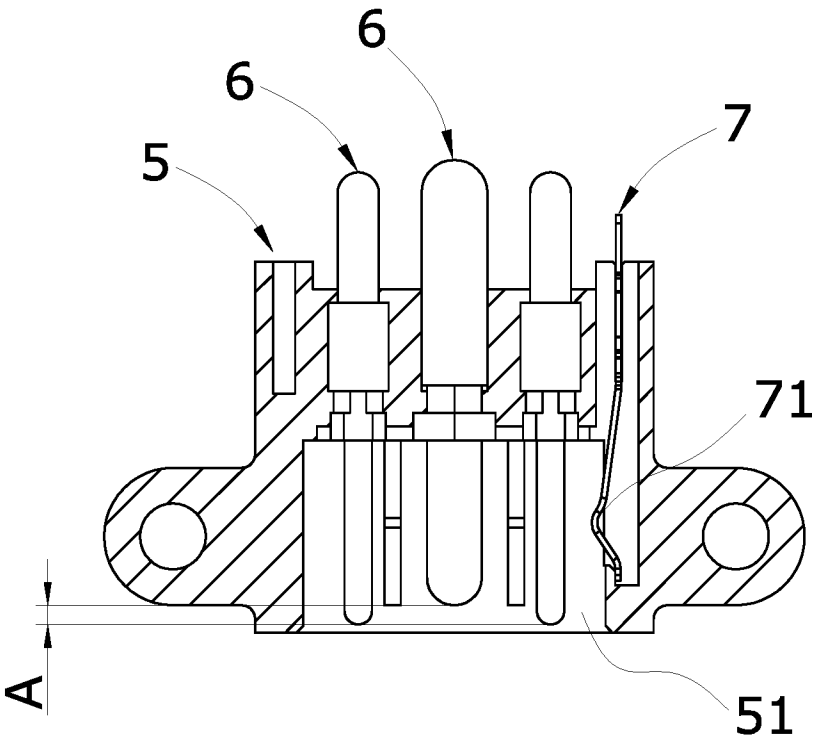
FIG. 9 shows a cutaway structural view of the charging button socket, according to the present invention.

In the present embodiment, there are three splices 6, and the polarity of the splice 6 at the center location is different from that at two sides. The polarities of these three splices 6 are negative pole, positive pole and negative pole, forming a negative terminal and a positive terminal. In addition, the negative terminal is longer than the positive terminal. As shown in FIG. 9, the length of the negative terminal is different from the length of the positive terminal by a gap A. The purpose of this design is to allow the conducting terminal 2 of the electric connector plug to contact with the negative terminal first (as shown in FIG. 10) and then the positive terminal when the electric connector plug butts with the electric connector socket, thereby preventing from the generation of spark upon contact.

The detecting terminal 7 is made of metal and is disposed in the detecting terminal holding chamber 53 of the socket body 5, so that an elastic contact part 71 at the front end thereof can be disposed at a side of the electric butting slot 51 of the socket body 5 to be extended into the electric butting slot 51. In addition, the welding part 72 at a tail end of the detecting terminal 7 is welded on a circuit board.

When the electric connector plug butts with the electric connector socket, the detecting terminal 7 will conduct electrically with the plug housing 4 (as shown in FIG. 1) of the electric connector plug to activate energization, thereby preventing from the generation of spark while butting.

Figure 10:
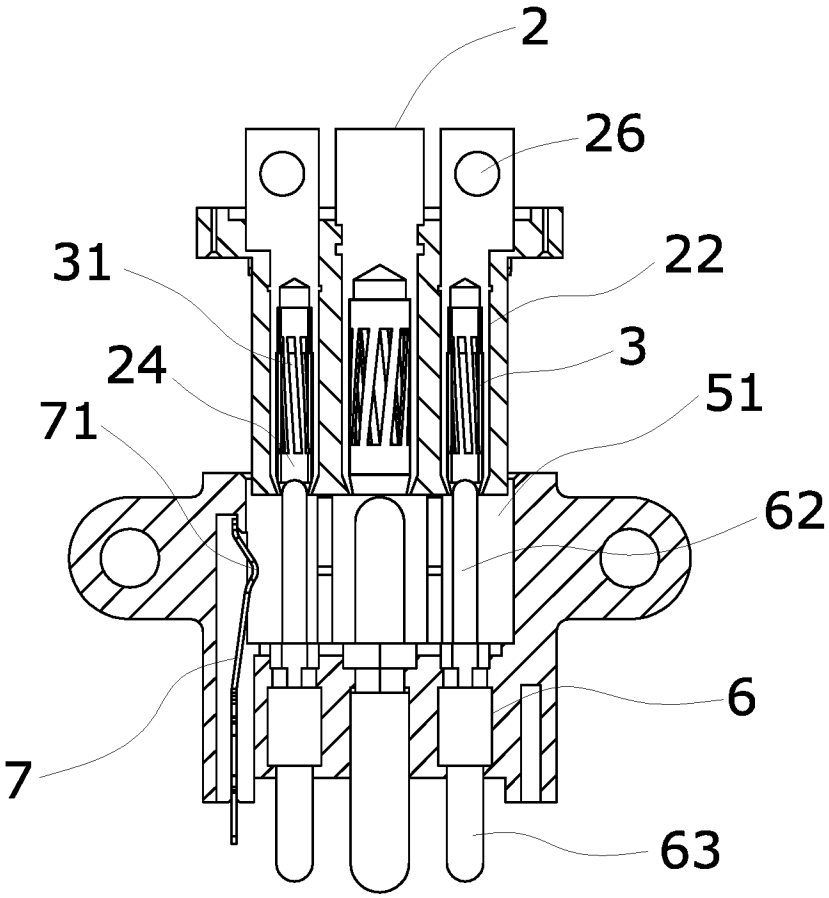
FIG. 10 shows a cutaway view of butting the charging button plug with the charging button socket, according to the present invention.

Referring to FIG. 10, in the present invention, when the electric connector plug butts with the electric connector socket, the design of contacting the negative pole of splice 6 first and then the positive pole of splice 6 can avoid the generation of spark while the positive pole and negative pole contact simultaneously. Furthermore, the provision of detecting terminal 7 can be used to detect when the electric connector plug is completely inserted into the electric connector socket, and to send out a signal to conduct electrically. In addition, when the splice 6 butts and contacts with the conducting terminal 2, the contact part 62 of the splice 6 will contact electrically with the conducting ring 3 in the conducting terminal 2 and can contact in multiple points with the separation slots 31 on the conducting ring 3, thereby avoiding the concentration of heat energy due to single-point contact in energizing.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An electric connector plug comprising:

a plug body, which includes a base and a body part extending from the base, with the plug body being provided with a conducting terminal holding chamber that penetrates the base and the body part;

plural conducting terminals, with each conducting terminal including a root as well as a contact part and a welding part extending respectively from an end of the root, the conducting terminal being inserted on the base of the plug body via the root, the contact part being accommodated in the conducting terminal holding chamber, the welding part being exposed out of the base of the plug body, and an interior at the front end of the contact part of the conducting terminal being formed with abutting slot;

plural conducting rings, with each conducting ring being disposed in the butting slot of the contact part of the conducting terminal and being formed with plural separation slots; and a plug housing which encloses the body part of the plug body;

wherein the conducting ring is a metallic annular structure and the separation slots are disposed obliquely and annularly relative to the conducting ring;

wherein the plug housing is made of metal, and an insertion part which is extended from a tail end thereof is inserted into the through-hole and slot of the plug body.

2. The electric connector plug according to claim 1, wherein each side of the base of the plug body is provided respectively with a through-hole and a slot is disposed between the body part and the base.

3. The electric connector plug according to claim 1, wherein the welding part of the conducting terminal is formed with a vertical plane and the vertical plane is further provided with a through-hole.

4. An electric connector socket comprising:

a socket body, which includes an electric butting slot, with a rear end of the electric butting slot being provided with plural splice through-holes and a detecting terminal holding chamber; plural splices, with each splice being inserted on the splice through-hole of the socket body, three splices being provided and configured in negative pole, positive pole and negative pole from left to right orderly, and the negative splice being longer than the positive splice; and a detecting terminal, which is disposed in the detecting terminal holding chamber of the socket body, with an elastic contact part at a front end of the detecting terminal being disposed at a side of the electric butting slot of the socket body to extend into the electric butting slot;

wherein the splice includes a root as well as a contact part and a welding part which are extended from an end of the root respectively;

wherein the contact part of the splice is disposed in the electric butting slot of the socket body, and the welding part is exposed out of a rear end of the socket body.

5. An electric connector assembly having an electric connector plug, and an electric connector socket, wherein, the electric connector plug comprising:

a plug body, which includes a base and a body part extending from the base, with the plug body being provided with a conducting terminal holding chamber that penetrates the base and the body part;

plural conducting terminals, with each conducting terminal including a root as well as a contact part and a welding part extending respectively from an end of the root, the conducting terminal being inserted on the base of the plug body via the root, the contact part being accommodated in the conducting terminal holding chamber, the welding part being exposed out of the base of the plug body, and an interior at the front end of the contact part of the conducting terminal being formed with a butting slot;

plural conducting rings, with each conducting ring being disposed in the butting slot of the contact part of the conducting terminal and being formed with plural separation slots; and a plug housing which encloses the body part of the plug body;

the electric connector socket comprising:

a socket body, which includes an electric butting slot, with a rear end of the electric butting slot being provided with plural splice through-holes and a detecting terminal holding chamber;

plural splices, with each splice being inserted on the splice through-hole of the socket body, three splices being provided and configured in negative pole, positive pole and negative pole from left to right orderly, and the negative splice being longer than the positive splice; and a detecting terminal, which is disposed in the detecting terminal holding chamber of the socket body, with an elastic contact part at a front end of the detecting terminal being disposed at a side of the electric butting slot of the socket body to extend into the electric butting slot;

wherein the electric connector plug butts with the electric connector socket, allowing the splice to butt with the conducting terminal to conduct electrically.

* * * * *